US008083600B2

(12) United States Patent
Sheets et al.

(10) Patent No.: US 8,083,600 B2
(45) Date of Patent: Dec. 27, 2011

(54) SWING SEAT

(75) Inventors: Ernie D. Sheets, Amarillo, TX (US); Julie A. Neusch, Amarillo, TX (US)

(73) Assignee: Backyard Leisure Holdings, Inc., Pittsburg, KS (US)

( * ) Notice: Subject to any disclaimer, the term of this patent is extended or adjusted under 35 U.S.C. 154(b) by 62 days.

(21) Appl. No.: 12/577,023

(22) Filed: Oct. 9, 2009

(65) Prior Publication Data

US 2011/0086718 A1 Apr. 14, 2011

(51) Int. Cl.
*A63G 9/10* (2006.01)
*A63G 9/00* (2006.01)

(52) U.S. Cl. ..... 472/118; 297/273

(58) Field of Classification Search ..... 472/118–125; 297/45, 273, 274, 277, 441, 445, 457, 462, 297/463
See application file for complete search history.

(56) References Cited

U.S. PATENT DOCUMENTS 3,897,056 A * 7/1975 Hock et al. ..... 472/118
4,066,258 A * 1/1978 Yates ..... 472/118
4,524,966 A * 6/1985 Shannon et al. ..... 472/118
4,575,073 A * 3/1986 Thacker ..... 472/118
4,793,607 A * 12/1988 Suellentrop ..... 472/118
5,238,456 A * 8/1993 Chang ..... 472/118

* cited by examiner

*Primary Examiner* — Kien Nguyen

(74) *Attorney, Agent, or Firm* — Hovey Williams LLP

(57) ABSTRACT

A swing seat assembly is provided for enhancing durability of the swing and increasing the safety of a person using the swing. The swing seat assembly includes an elongated seat element and a reinforcing member extending along the seat element. The reinforcing member is formed of a different material than the seat element and has a tensile strength that is greater than the tensile strength of the seat element. The assembly also includes a pair of rigid connecting elements configured to operably couple the seat element with suspending elements, where the connecting elements at least partially project from end margins of the seat element but do not extend inwardly beyond a top face of the seat element. A swing assembly is also provided that includes a reinforced swing seat with a reinforcing member extending therealong and being encased therein. The swing assembly includes a pair of suspending elements coupled to hooks projecting from end margins of the seat for suspending the seat from a playset frame.

32 Claims, 2 Drawing Sheets

SWING SEAT

BACKGROUND OF THE INVENTION

1. Field of the Invention

The present invention relates generally to children's playsets, and to playset accessories and components. More specifically, the present invention concerns a reinforced swing seat assembly for use in a children's playset.

2. Discussion of the Prior Art

Those of ordinary skill in the art will appreciate that swing seats used with playsets have historically taken many forms. For example, rigid swing seats have been formed of wooden boards or molded plastics. Many current swing seats are formed from rubber or other flexible material that allows the seat to bend for comfortably accommodating users of different sizes. Regardless of material, swing seats are often suspended from a playset frame with ropes or chains so that the seat may freely swing back and forth during use.

Conventional flexible swing seats often include a generally rectangular strap of rubber that is connected to suspending chains at opposite ends of the strap. Some rubber strap seats include hinged rings clamped to the opposite ends of the strap, with each ring receiving a hooked end of a suspending chain. Other rubber strap seats simply include a hole disposed at each opposite end of the strap to receive the hooked end of a suspending chain. Some such seats include local reinforcement (such as a grommet) around the holes to prevent the hook from tearing through the rubber of the seat.

While traditional flexible swing seats have been satisfactory in some respects, they have also presented drawbacks. For example, rubber strap seats provide comfortable flexibility, but are also prone to deterioration from continued outdoor exposure to the sun or to other forms of breakage from extended use. As the rubber strap begins to wear, the material eventually fails, causing the swing to break. If the swing breaks under the weight of a child using the swing, then the strap can separate into two halves, frequently causing the child to fall and suffer an injury. Even if the swing breaks when no child is present, the strap will require replacement before the swing can be safely used again.

In addition to the risk of deterioration or other breakage of the rubber strap seat, the connection between a conventional seat and the suspending chains often involves hooked ends of a chain being received through a hole in the end margin of the seat or a hinged ring attached thereto. Those of ordinary skill in the art will appreciate that the hooked ends of the chains often point inward (toward a child, along the same general end-to-end direction in which the seat extends). Inwardly projecting hooks are particularly prevalent with strap seats where the chains are received through holes in the end margins. These hooks or other connecting elements protrude inward towards a child during use of the swing and can cause injury, particularly during mounting or dismounting of the swing. The danger presented by inwardly projecting hooks is exacerbated when the end margins of the strap shift due to deterioration or breakage, presenting a significant danger to a child using such a swing.

SUMMARY

The present invention provides a reinforced swing seat assembly for use in a playset that preferably includes an elongated seat element with a reinforcing member extending therealong, and connecting elements operably associated with the reinforcing member for coupling the seat element to suspending elements. The reinforcing member prevents breakage of the seat element by adding tensile strength between end margins thereof, and the preferred construction of the connecting elements eliminates inwardly oriented projections that may otherwise injure a child using the swing. The features provided by the swing seat assembly maintain safe operation of the swing.

According to one aspect of the present invention, a reinforced swing seat assembly is provided for use in a playset. The assembly includes an elongated seat element that presents a top face, a bottom face, and opposite end margins. The assembly also includes a reinforcing member that extends along the seat element. The reinforcing member comprises a different material than the seat element and has a tensile strength that is greater than the tensile strength of the seat element. The reinforcing member extends continuously from one end margin of the seat element to the other, and includes an elongated central portion and opposite end portions. The assembly further includes a pair of rigid connecting elements that are configured to operably couple the seat element with suspending elements. Each of the connecting elements is operably associated with a respective one of the end portions of the reinforcing member and at least partially projects from a corresponding one of the end margins of the seat element. Each of the connecting elements extends generally away from the corresponding end margin of the seat element along a connection plane. Each of the connection planes is generally parallel with at least a portion of the top face of the seat element adjacent the corresponding connecting element such that the connecting elements are prevented from extending inwardly beyond the top face of the seat element.

Another aspect of the present invention concerns a swing assembly for use in a playset. The assembly includes a pair of suspending elements configured for suspending the swing seat from a frame of the playset. The assembly further includes a reinforced swing seat that presents a top face, a bottom face, and opposite end margins. The swing seat includes a reinforcing member that extends along the seat and is encased therein. The reinforcing member is formed of a different material than the seat and has a tensile strength that is greater than the tensile strength of the seat. The reinforcing member extends continuously from one end margin of the seat to the other, and includes an elongated central portion and opposite end portions. The swing seat includes a pair of hooks, where each hook is associated with a respective one of the end portions of the reinforcing member and at least partially projects from a corresponding one of the end margins of the seat. Each of the hooks is operably coupled with a respective one of the suspending elements. Each of the hooks extends generally away from the corresponding end margin of the seat along a connection plane, where each connection plane is generally parallel with at least a portion of the top face of the seat adjacent the corresponding hook such that the hooks are prevented from extending inwardly beyond the top face of the seat.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing figures, wherein.

Figures 3, 4, 5:
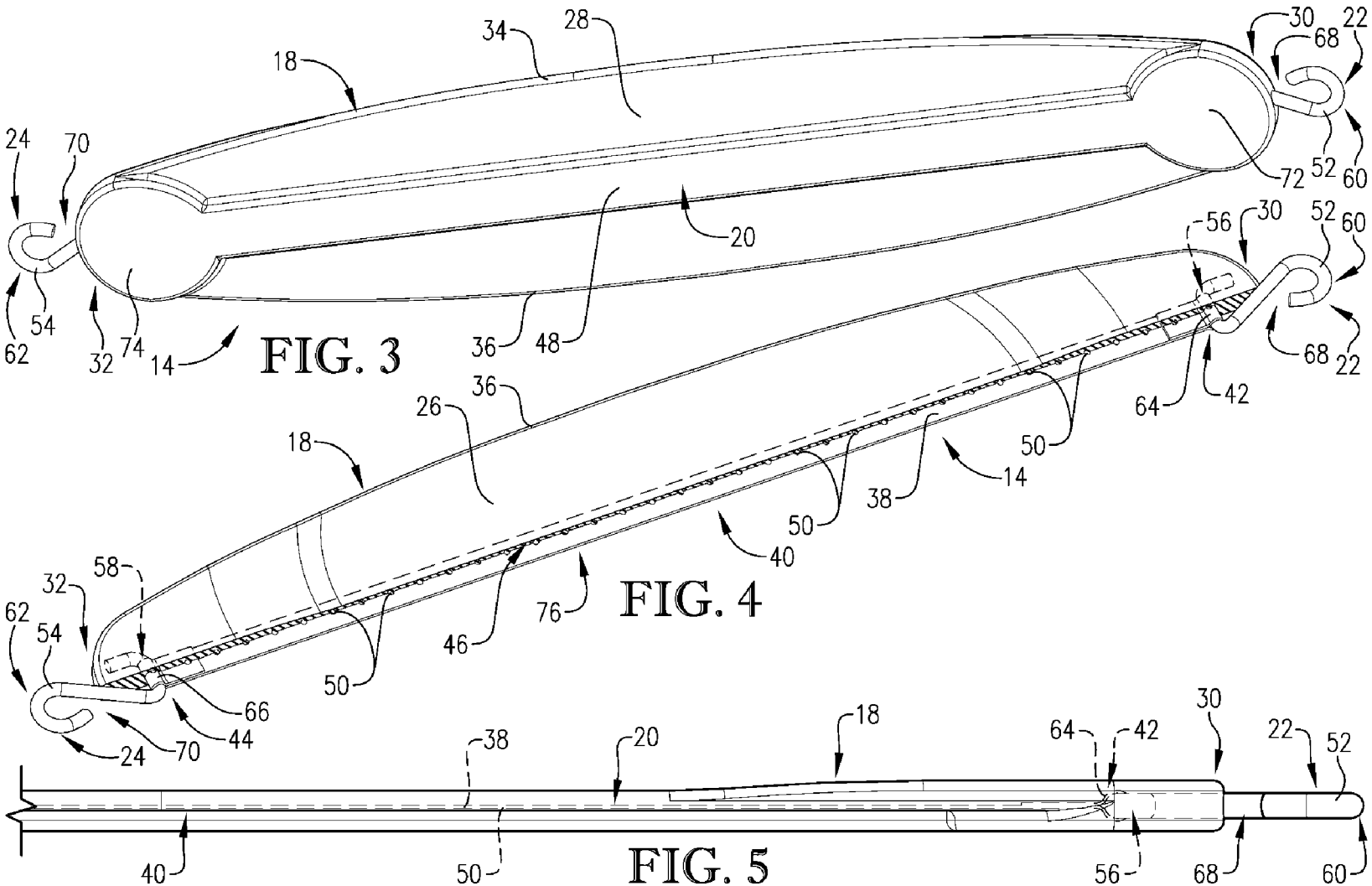
FIG. 3 is bottom side perspective view of the swing seat assembly shown in FIG. 2, illustrated without the suspending chains, depicting structural details of the seat element in a flat, unflexed condition, and particularly depicting details of an encasement strip enveloping a reinforcing strap and the partially encased connecting hooks.

FIG. 4 is a cutaway, top side perspective view of the swing seat assembly shown in FIG. 3, illustrated with a portion of the seat element removed along a bisecting longitudinal axis to depict in detail the reinforcing strap with a plurality of holes therein, through which the material of the seat element extends, and the connecting hooks operably associated with opposite end portions of the strap; and FIG. 5 is an enlarged, fragmentary, elevational view of the swing seat assembly shown in FIG. 4, illustrated with elements within the material of the seat element in broken lines, depicting in detail the encased reinforcing strap and one of the partially encased connecting hooks associated therewith.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 2:
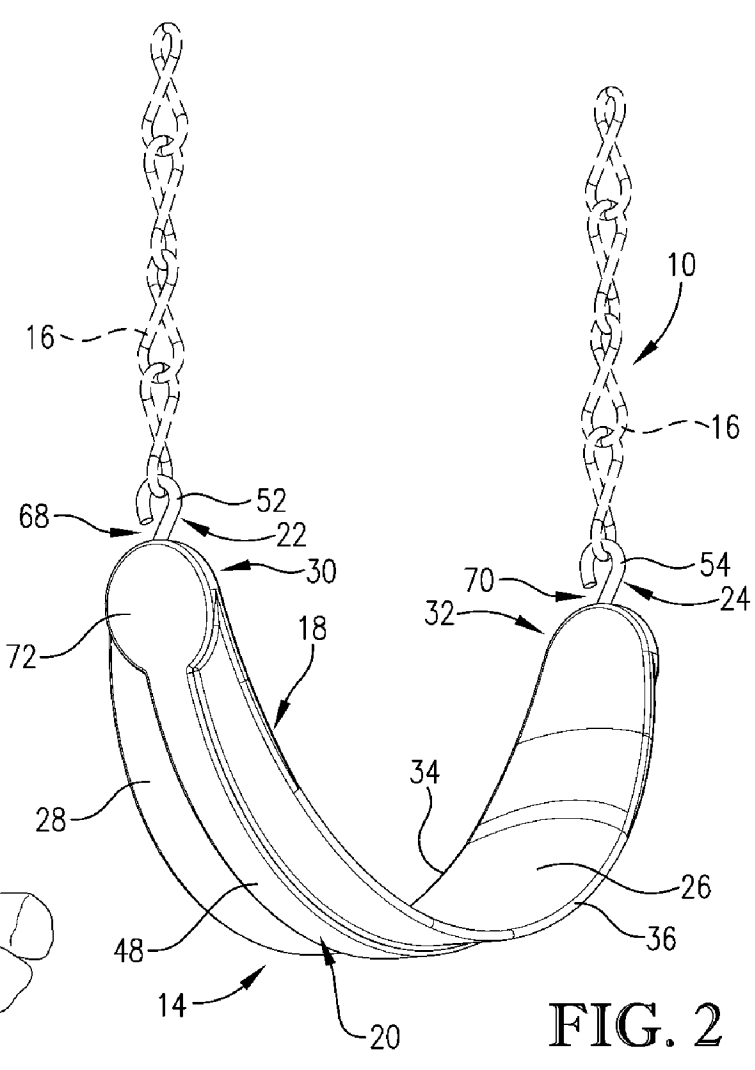
FIG. 2 is perspective view of the swing seat assembly shown in FIG. 1, illustrated with the suspending chains in broken lines and without the child, depicting structural details of the seat element in a flexed condition and connecting hooks projecting therefrom.
Figure 1:
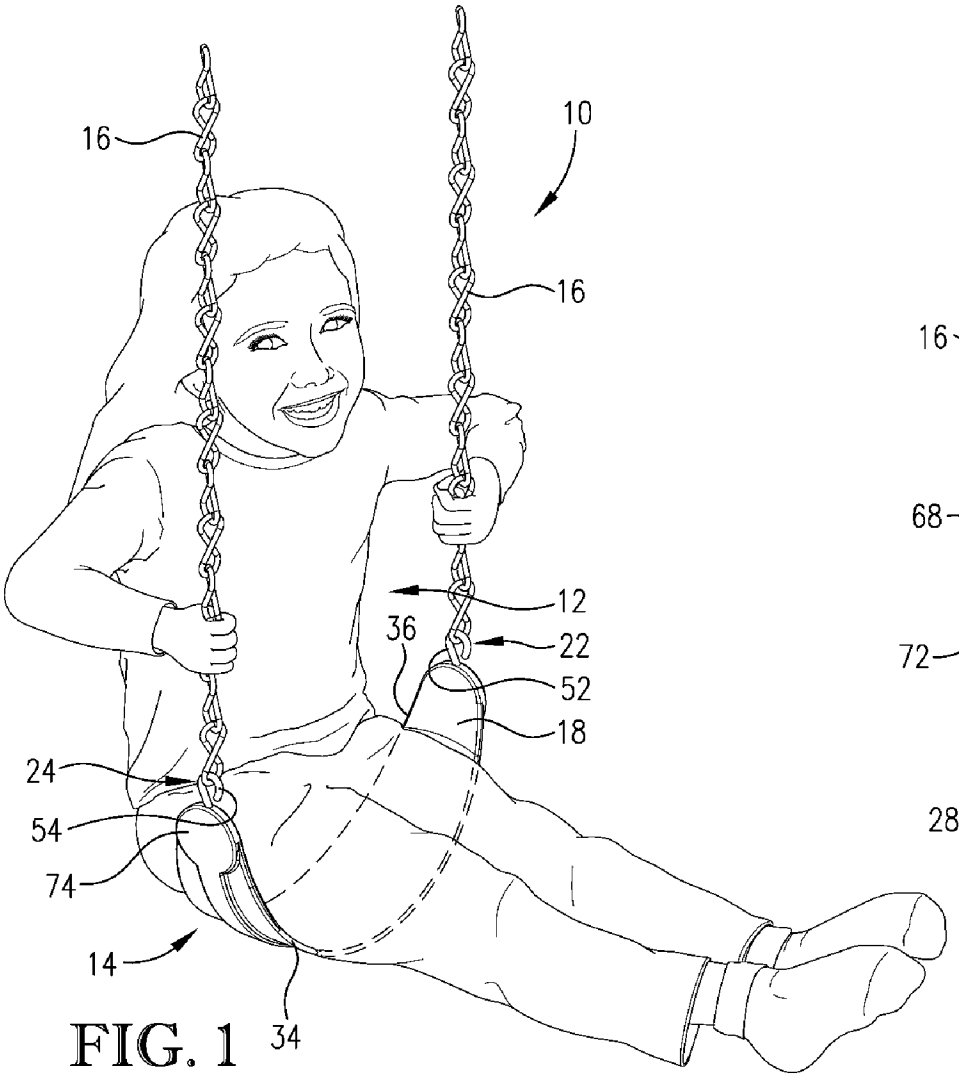
FIG. 1 is perspective view of a swing seat assembly constructed in accordance with the principles of a preferred embodiment of the present invention, shown with suspending chains connected to a seat element in a flexed condition with a child seated thereon.

With initial reference to FIGS. 1 and 2, a swing assembly 10 constructed in accordance with a preferred embodiment of the present invention is illustrated with a child 12 sitting thereon. The swing assembly 10 broadly includes a reinforced swing seat assembly 14 and a pair of suspending elements in the form of chains 16 configured for suspending the seat assembly 14 from a frame of a playset (not shown), as described in detail below.

As shown in FIG. 1, the chains 16 for suspending the seat assembly 14 are conventional in construction and allow the seat assembly 14 to hang relatively freely from the frame of the playset (not shown). The chains 16 also provide gripable handles for use by the child 12 when playing on the swing assembly 10. While suspending chains 16 are illustrated in FIGS. 1 and 2, it is of course within the ambit of the present invention to support the seat assembly 14 with alternative suspending elements (such as ropes, cables, and the like), as will be readily appreciated by one of ordinary skill in the art upon review of this disclosure.

With continued attention to FIGS. 1 and 2, and looking also to FIGS. 3-5, the reinforced swing seat assembly 14 generally includes an elongated seat element 18, a reinforcing member 20 encased within the seat element 18, and a pair of rigid connecting elements 22, 24 each projecting from the seat element 18.

Regarding additional details of the elongated seat element 18, the seat element 18 presents a top face 26, an opposite bottom face 28, and opposite end margins 30, 32. The seat element 18 further presents a front edge margin 34 and an opposite rear edge margin 36. As shown in FIGS. 1 and 2, the seat element 18 is formed of a flexible material, such that the seat element 18 bends under the weight of a user (and/or its own weight) into a generally curved shape. The bending of the seat element 18 is shown in FIGS. 1 and 2, as compared to the relatively planar disposition of the seat element 18 when in an unflexed condition, as shown in FIGS. 3-5. While the seat element 18 is flexible, it is noted that an alternative seat element (not shown) may be generally rigid (e.g., preformed in a curved shape) without departing from the teachings of the present invention.

Generally speaking, the seat element 18 may be formed of any suitable material, as will be readily appreciated by one of ordinary skill in the art upon review of this disclosure. In particular, the illustrated seat element 18 is formed of ethylene-vinyl acetate ("EVA") that includes an ultra violet ("UV") stabilizer.

In the illustrated embodiment, the top face 26 of the seat element 18 is substantially smooth and configured to be sat upon by a user, such as the child 12. Alternative seat element embodiments (not shown) may also include a bottom face that is configured to be sat upon by a user, such that the seat element may be reversible, without departing from the teachings of the present invention. While the depicted top face 26 of the seat element 18 is substantially smooth, the inclusion of surface features (such as textured ridges, a logo, and/or the like) formed on the surface of or as part of the top face 26 (such as for grip or aesthetic purposes) is naturally within the ambit of the present invention. The bottom face 28 of the seat element 18 includes various surface features that are described in detail below.

As shown in FIG. 3, the seat element 18 presents a generally oval shape when in an unflexed condition, although alternate shapes (e.g., a rectangle) are possible without departing from the teachings of the present invention. In more detail, the depicted seat element 18 presents a length dimension of approximately thirty inches (30") (between the end margins 30, 32), a maximum, central width dimension of approximately six and one-eighth inches (6⅛") (between midpoints of the front edge margin 34 and the rear edge margin 36), and a thickness dimension ranging between approximately one-fourth inch (¼") and five-eighths inch (⅝") (between the top face 26 and the bottom face 28). It is noted that the dimensions of the illustrated swing seat 18 are provided by way of example only and are not to be construed as limiting, as numerous shapes and/or sizes of swing seats may be alternatively configured, as will be readily appreciated by one of ordinary skill in the art upon review of this disclosure.

With attention to FIGS. 4 and 5, and turning now to additional details of the reinforcing member 20, the reinforcing member 20 is depicted in the form of a single metal strap 38. It is noted that the metal strap 38 is illustrated by way of example only, as alternative reinforcing members constructed of other materials or shapes (e.g., a steel cable or a synthetic resin material) may be incorporated without departing from the teachings of the present invention. The metal strap 38 (or an alternative reinforcing member) extends along the seat element 18 and is formed of a different material than the seat element 18. The metal strap 38 has a greater tensile strength than the material of the seat element 18. The greater tensile strength of the metal strap 38 provides a safeguard against breakage of the seat element 18, particularly during extended use, thereby preventing injury to a user of the swing assembly 10.

The metal strap 38 includes an elongated central portion 40 that stretches between opposite end portions 42, 44 of the metal strap 38. In the illustrated embodiment, the metal strap 38 extends continuously from one end margin 30 of the seat element 18 to the other end margin 32 of the seat element 18, such that each end portion 42, 44 of the metal strap 38 corresponds to a respective end margin 30, 32 of the seat element 18. In more detail, the seat element 18 includes a generally longitudinal axis 46 that extends between the end margins 30, 32 to generally bisect the seat element 18, with the metal strap 38 being disposed generally along the longitudinal axis 46. As depicted, the metal strap 38 lies within a plane that is substantially parallel to the top face 26 of the seat element 18.

The metal strap 38 is preferably flexible so that, as the seat element 18 bends under the weight of a user (as described above), the metal strap 38 will likewise bend. It is noted that flexibility of a reinforcing member 20 is not necessary (such as may be appropriate for an alternative inflexible seat element), although it is preferred that both the seat element 18 and the reinforcing member 20 be flexible to provide comfort to a user.

With specific attention to FIG. 5, the metal strap 38 is encased within the material of the seat element 18. Referring particularly to FIGS. 2 and 3, it will be readily apparent that the metal strap 38 is disposed within an encasement strip 48 that is coextensive with the metal strap 38 (i.e., the encasement strip 48 extends continuously from one end margin 30 of the seat element 18 to the other end margin 32 of the seat element 18). The encasement strip 48 defines a portion of the bottom face 28 of the seat element 18. While the preferred embodiment includes the metal strap 38 being entirely encased within the seat element 18, such total encasement is not necessary as the metal strap 38 (or an alternative reinforcing member) may be only partially encased within the seat element 18 or maybe entirely separate therefrom (such as a reinforcing member that may extend underneath the seat element 18 along the bottom face 28 thereof).

Turning briefly to details shown in FIG. 4, the metal strap 38 includes a plurality of holes 50 extending therethrough. The holes 50 extend through the metal strap 38 in a direction substantially orthogonal to the top face 26 of the seat element 18, with the material of the seat element 18 extending through the holes 50. The relationship of the material of the seat element 18 passing through the holes 50 of the metal strap 38 helps to securely bond the metal strap 38 within the seat element 18. While the plurality of holes 50 are depicted in a substantially linear arrangement disposed along the longitudinal axis 46, alternative patterns of holes or openings are within the ambit of the present invention.

It is noted that while the illustrated metal strap 38 includes holes 50 disposed along substantially the entire length thereof, an alternative strap (not shown) may only include openings disposed along a portion of the length thereof. It is believed that it is preferable for a reinforcing strap to include openings disposed at least partially along a central portion thereof. It is further noted that the illustrated metal strap 38 is devoid of any protrusions projecting in a direction substantially orthogonal to the top face 26 of the seat element 18 along the central portion 40 of the metal strap 38. The absence of such protrusions prevents any reinforcing material along the central portion 40 of the metal strap 38 from the projecting inwardly towards a user of the swing assembly 10, such as the child 12, further helping to prevent injury.

As shown in FIG. 4, the metal strap 38 presents a generally rectangular shape when in an unflexed condition, although alternative shapes (or alternative reinforcing members) are possible without departing from the teachings of the present invention. In more detail, the depicted metal strap 38 presents a length dimension within the seat element 18 of approximately twenty-seven and eleven-sixteenths inches ($27\frac{11}{16}$") (between the end portions 42, 44), a width dimension of approximately three-fourths inch (¾"), and a thickness dimension of approximately seventeen-one-hundredths inch ($\frac{17}{100}$") (lending to the flexibility of the metal strap 38). Each of the holes 50 presents a diameter of approximately nine-sixty-fourths inch ($\frac{9}{64}$"), with adjacent holes 50 being spaced approximately three-fourths inch (¾") from one another. It is noted that the dimensions of the illustrated metal strap 38 are provided by way of example only and are not to be construed as limiting, as numerous shapes and/or sizes of metal straps or other reinforcing members may be alternatively configured, as will be readily appreciated by one of ordinary skill in the art upon review of this disclosure.

Next, with regard to additional details of the rigid connecting elements 22, 24, the connecting elements 22, 24 are depicted in the form of modified S-hooks 52, 54. It is noted that the S-hooks 52, 54 are illustrated by way of example only, as alternative connecting elements could take other forms (e.g., continuous rings) without departing from the teachings of the present invention. Each hook 52, 54 generally includes a straight strap connecting section 56, 58 and a curved chain connecting section 60, 62.

The hooks 52, 54 are operably associated with the end portions 42, 44 of the metal strap 38. In the embodiment depicted, each end portion 42, 44 includes a loop 64, 66 with each straight strap connecting section 56, 58 being received within a respective one of the loops 64, 66 to couple the hooks 52, 54 with the metal strap 38. The loops 64, 66 are defined by a section of each of the end portions 42, 44 of the strap 38 being doubled over and welded to itself to form each loop 64, 66, as described in detail below. As will be readily appreciated by one of ordinary skill in the art upon review of this disclosure, the hooks 52, 54 could alternatively be associated with the end portions 42, 44 of the metal strap 38 in other suitable ways (such as by crimping) without departing from the teachings of the present invention.

The curved chain connecting sections 60, 62 of the hooks 52, 54 each include a gap 68, 70 that provides for a selected link of the suspending chains 16 to be received within each curved chain connecting section 60, 62 of the hooks 52, 54. The selection of a particular link of the suspending chains 16 to be received within the hooks 52, 54 may be made to adjustably set the overall height of the swing seat assembly 14, as will be readily appreciated by one of ordinary skill in the art upon review of this disclosure. It is noted that various alternatives for securing the rigid connecting elements 22, 24 to the chains 16 (other than receipt of links of the chains 16 within the hooks 52, 54), such as the incorporation of a moveable gate link (not shown), are possible without departing from the teachings of the present invention.

The depicted hooks 52, 54 are formed of rigid steel, although the use of other suitable substantially rigid materials is clearly within the ambit of the present invention. The structural relationship of the hooks 52, 54 being directly coupled with the reinforcing metal strap 38 contributes to the robustness of the swing assembly 10, as the connection between the suspending chains 16 and the hooks 52, 54 is tied directly to the reinforcing metal strap 38, which extends continuously along the length of the seat element 18.

In the illustrated embodiment, the metal strap 38 has a tensile strength that is greater than a deformation load threshold of the hooks 52, 54. The deformation load threshold of the hooks 52, 54 is the force threshold above which the hooks 52, 54 will start to deform. In other words, as a tensile force is applied to the hooks 52, 54 above the deformation load threshold, the curved chain connection sections 60, 62 of the hooks 52, 54 will deform and begin to straighten out (thereby allowing the gaps 68, 70 to gradually expand), eventually allowing the selected links of the suspending chains 16 received therein to fall out of association with the hooks 52, 54.

In more detail, a preferred embodiment of the metal strap 38 presents a tensile strength of approximately 1310 pounds of force, while each of the hooks 52, 54 present a deformation load threshold of approximately 500 pounds of force. Thus, the reinforced seat assembly 14 is designed such that the hooks 52, 54 will sufficiently deform as explained above to an extent where the suspending chains 16 are disassociated from the hooks 52, 54 prior to failure of the metal strap 38 within the seat element 18.

The hooks 52, 54 also at least partially project from the end margins 30, 32 of the swing seat element 18. With particular reference to FIG. 5, the hooks 52, 54 extend generally away from the corresponding end margins 30, 32 of the seat element 18 along connection planes (while only one hook 54 shown in detail, it will be readily appreciated that the construction of the other hook 52 is substantially the same). As shown in detail in FIG. 5, the connection planes are generally parallel with at least a portion of the top face 26 of the seat element 18 located adjacent the corresponding hook 52, 54 such that the hooks 52, 54 are prevented from extending inwardly beyond the top face 26 of the seat element 18.

As shown in FIGS. 1-5, the hooks 52, 54 are partially encased within the material of the seat element 18. More specifically, the straight strap connecting sections 56, 58 of the hooks 52, 54 are encased within the material of the seat element 18, while the curved chain connecting sections 60, 62 of the hooks 52, 54 are not so encased. The partial encasement of the hooks 52, 54 within the material of the seat element 18 retains the hooks 52, 54 in position such that the hooks 52, 54 are prevented from extending inwardly beyond the top face 26 of the seat element 18. Thus, even as the seat element 18 bends (as shown in FIGS. 1 and 2), the hooks 52, 54 remain outside of the connection planes that are parallel with top face 26, ensuring safe operation of the swing assembly 14 by a user.

Referring particularly to FIG. 3, it will be readily apparent that the portions of the hooks 52, 54 that are encased within the material of the seat element 18 (including the straight strap connecting sections 56, 58) are disposed within opposite, generally circular encasement ends 72, 74. The encasement ends 72, 74 each define a portion of the bottom face 28 of the seat element 18, and the encasement ends 72, 74 of the illustrated embodiment smoothly merge with the encasement strip 48 that houses the central portion 40 of the reinforcing metal strap 38. The additional material of the seat element 18 comprising the encasement ends 72, 74 contributes to the overall strength of the swing seat assembly 14 and, in particular, to the control of the disposition of the hooks 52, 54 relative to the seat element 18.

The formation of the swing seat assembly 14 should be apparent from the foregoing and, therefore, will be described here only briefly. Initially, the reinforcing metal strap 38 and the steel S-hooks 52, 54 are formed and joined together to form a subassembly 76. In order to form the loops 64, 66 in the metal strap 38 and maintain the desired length of the strap 38, it should be evident that the original length of the strap 38 must be longer than desired in final form. For example, the depicted metal strap 38 presents an original length dimension of approximately thirty-one inches (31") (shortened to the approximately twenty-seven and eleven-sixteenths inches ($27\frac{11}{16}$") described above after formation of the loops 64, 66).

The loops 64, 66 are formed by doubling over a section of each of the end portions 42, 44 of the strap 38 onto themselves. Next, the hooks 52, 54 are associated with the strap 38 by receiving the straight strap connecting sections 56, 58 of each of the hooks 52, 54 within the respective loops 64, 66. Finally, the hooks 52, 54 are fixedly coupled to the strap 38 by securing the doubled over section of the each end portions 42, 44 to the remainder of the strap 38. In the depicted embodiment, this securement is accomplished by spot welding the doubled over section of the each end portions 42, 44 to the remainder of the strap 38, although other securing procedures (such as crimping) are within the ambit of the present invention.

It is noted that when forming the holes 50 or other openings in the strap 38, it is important that any burrs that may be formed by drilling or stamping the holes 50 be removed such that the strap 38 is devoid of any protrusions projecting in a direction substantially orthogonal to the top face 26 of the seat element 18 along the central portion 40 of the metal strap 38. Once the hooks 52, 54 are secured to the strap 38 to form the subassembly 76, then the seat element 18 may be molded around the subassembly 76 of the strap 38 and the hooks 52, 54.

As will be readily understood by one of ordinary skill in the art upon review of this disclosure, a mold (not shown) may be created in a desired shape to form the seat element 18. The subassembly 76 of the strap 38 and the hooks 52, 54 is inserted into the mold and then the material for the seat element 18 (EVA in the depicted embodiment) is inserted into the mold. In this way, the material of the seat element 18 is molded around the strap 38 and the hooks 52, 54, securing the same within the seat element 18. In more detail, the material of the seat element 18 passes through the holes 50 of the metal strap 38 to securely bond the metal strap 38 within the seat element 18.

The formation process of molding the seat element 18 over the subassembly of the strap 38 and the hooks 52, 54 also creates the encasement strip 48 that envelops the metal strap 38 and the encasement ends 72, 74 that envelop portions of the hooks 52, 54, as described in detail above. The encasement strip 48 provides protection for the metal strap 38 from exposure to the elements and also prevents contact with any edges or other interference of the strap 38 by a user of the swing assembly 10. The encasement ends 72, 74 cooperate with the connection (loops 64, 66) between the strap 38 and the hooks 52, 54 to securely retain the hooks 52, 54 so that the hooks 52, 54 are restrained from extending past the connection planes that are parallel with top face 26 of the seat element 18.

The restraint of the rigid connection elements 22, 24 from extending inward toward a user of the swing assembly 10 promotes safe operation of the swing assembly 14 by a user and prevents injuries that can be caused by such rigid elements projecting inwardly in conventional swings. Finally, the seat assembly 14 is suspended from chains 16 at the desired height, as described above, and the chains 16 are suspended from a playset frame (not shown), so that the swing seat assembly 14 hangs relatively freely for safe enjoyment by a user, such as the child 12.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A reinforced swing seat assembly for use in a playset, said assembly comprising:

an elongated seat element presenting a top face, a bottom face, and opposite end margins;

a reinforcing member extending along the seat element, said reinforcing member comprising a different material than the seat element, said reinforcing member having a tensile strength that is greater than the tensile strength of the seat element, said reinforcing member extending continuously from one end margin of the seat element to the other, said reinforcing member including an elongated central portion and opposite end portions; and a pair of rigid connecting elements configured to operably couple the seat element with suspending elements, each of said connecting elements being operably associated with a respective one of the end portions of the reinforcing member and at least partially projecting from a corresponding one of the end margins of the seat element, each of said connecting elements extending generally away from the corresponding end margin of the seat element along a connection plane, each of said connection planes being generally parallel with at least a portion of the top face of the seat element adjacent the corresponding connecting element such that the connecting elements are prevented from extending inwardly beyond the top face of the seat element, said reinforcing member being at least partially encased within the seat element, said reinforcing member including a plurality of openings defined therein, each of said openings extending through the reinforcing member in a direction substantially orthogonal to the top face of the seat element, said seat element being formed of a material that extends through the plurality of openings.

2. The swing seat assembly as claimed in claim 1, said reinforcing member being flexible.

3. The swing seat assembly as claimed in claim 1, said reinforcing member consisting essentially of a single metal strap.

4. The swing seat assembly as claimed in claim 3, said metal strap being entirely encased within the seat element.

5. The swing seat assembly as claimed in claim 1, said reinforcing member being devoid of any protrusions projecting in a direction substantially orthogonal to the top face of the seat element along the central portion thereof.

6. The swing seat assembly as claimed in claim 1, said seat element being flexible.

7. The swing seat assembly as claimed in claim 1, said seat element presenting a generally oval shape.

8. The swing seat assembly as claimed in claim 1, said top face of the seat element being substantially smooth.

9. The swing seat assembly as claimed in claim 1, said seat element being formed of ethylene-vinyl acetate.

10. The swing seat assembly as claimed in claim 9, said seat element including an ultra violet stabilizer.

11. The swing seat assembly as claimed in claim 1, each of said connecting elements being partially encased within the seat element.

12. The swing seat assembly as claimed in claim 11, said connecting elements comprising hooks, each of said hooks including an opening configured to operably receive the suspending elements.

13. The swing seat assembly as claimed in claim 12, said reinforcing member comprising a metal strap, said strap including a loop at each end portion thereof, each of said hooks being at least partially received within a respective loop of the strap.

14. A reinforced swing seat assembly for use in a playset, said assembly comprising:

an elongated seat element presenting a top face, a bottom face, and opposite end margins;

a reinforcing member extending along the seat element, said reinforcing member comprising a different material than the seat element, said reinforcing member having a tensile strength that is greater than the tensile strength of the seat element, said reinforcing member extending continuously from one end margin of the seat element to the other, said reinforcing member including an elongated central portion and opposite end portions; and a pair of rigid connecting elements configured to operably couple the seat element with suspending elements, each of said connecting elements being operably associated with a respective one of the end portions of the reinforcing member and at least partially projecting from a corresponding one of the end margins of the seat element, each of said connecting elements extending generally away from the corresponding end margin of the seat element along a connection plane, each of said connection planes being generally parallel with at least a portion of the top face of the seat element adjacent the corresponding connecting element such that the connecting elements are prevented from extending inwardly beyond the top face of the seat element, said seat element including longitudinal axis extending between the end margins thereof and generally bisecting the seat element, said reinforcing member being disposed along the longitudinal axis.

15. The swing seat assembly as claimed in claim 14, said reinforcing member being at least partially encased within the seat element.

16. The swing seat assembly as claimed in claim 3, said reinforcing member including a plurality of openings defined therein.

17. The swing seat assembly as claimed in claim 16, each of said openings extending through the reinforcing member in a direction substantially orthogonal to the top face of the seat element.

18. The swing assembly as claimed in claim 14, said reinforcing member being flexible.

19. The swing seat assembly as claimed in claim 14, said reinforcing member consisting essentially of a single metal strap.

20. The swing seat assembly as claimed in claim 19, said metal strap being entirely encased within the seat element.

21. The swing seat assembly as claimed in claim 14, said reinforcing member being devoid of any protrusions projecting in a direction substantially orthogonal to the top face of the seat element along the central portion thereof.

22. The swing seat assembly as claimed in claim 14, said seat element being flexible.

23. The swing seat assembly as claimed in claim 14, said seat element presenting a generally oval shape.

24. The swing seat assembly as claimed in claim 14, said top face of the seat element being substantially smooth.

25. The swing seat assembly as claimed in claim 14, said seat element being formed of ethylene-vinyl acetate.

26. The swing seat assembly as claimed in claim 25, said seat element including an ultra violet stabilizer.

27. The swing seat assembly as claimed in claim 14, each of said connecting elements being partially encased within the seat element.

28. The swing seat assembly as claimed in claim 27, said connecting elements comprising hooks, each of said hooks including an opening configured to operably receive the suspending elements.

29. The swing seat assembly as claimed in claim 28, said reinforcing member comprising a metal strap, said strap including a loop at each end portion thereof, each of said hooks being at least partially received within a respective loop of the strap.

30. A reinforced swing seat assembly for use in a playset, said assembly comprising:

an elongated seat element presenting a top face, a bottom face, and opposite end margins;

a reinforcing member extending along the seat element, said reinforcing member comprising a different material than the seat element, said reinforcing member having a tensile strength that is greater than the tensile strength of the seat element, said reinforcing member extending continuously from one end margin of the seat element to the other, said reinforcing member including an elongated central portion and opposite end portions; and a pair of rigid connecting elements configured to operably couple the seat element with suspending elements, each of said connecting elements being operably associated with a respective one of the end portions of the reinforcing member and at least partially projecting from a corresponding one of the end margins of the seat element, each of said connecting elements extending generally away from the corresponding end margin of the seat element along a connection plane, each of said connection planes being generally parallel with at least a portion of the top face of the seat element adjacent to the corresponding connecting element such that the connecting elements are prevented from extending inwardly beyond the top face of the seat element, each of said connecting elements being partially encased within the seat element, said connecting elements comprising hooks, each of said hooks including an opening configured to operably receive the suspending elements, said reinforcing member comprising a metal strap, said strap including a loop at each end portion thereof, each of said hooks being at least partially received within a respective loop of the strap, each of said loops being defined by a first section of the strap doubled over a second section of the strap and welded thereto.

31. A swing assembly for use in a playset, said assembly comprising:

a pair of suspending elements configured for suspending the swing seat from a frame of the playset; and a reinforced swing seat presenting a top face, a bottom face, and opposite end margins, said swing seat including a reinforcing member extending along the seat and being encased therein, said reinforcing member being formed of a different material than the seat and having a tensile strength that is greater than the tensile strength of the seat, said reinforcing member extending continuously from one end margin of the seat to the other, said reinforcing member including an elongated central portion and opposite end portions, said swing set including a pair of hooks, with each hook being associated with a respective one of the end portion of the reinforcing member and at least partially projecting from a corresponding one of the end margin of the seat, each of said hooks being operably coupled with a respective one of the suspending elements, each of said hooks extending generally away from the corresponding end margin of the seat along a connection plane, with each connection plane being generally parallel with at least a portion of the top face of the seat adjacent the corresponding hook such that the hooks are prevented from extending inwardly beyond the top face of the seat, said reinforcing member including a plurality of openings defined therethrough, each of said openings extending through the reinforcing member in a direction substantially orthogonal to the top face of the swing seat, said swing seat being formed of a material that extends through the plurality of openings.

32. The swing assembly as claimed in claim 31, said suspending elements comprising chains.

* * * * *